US006512434B1

(12) United States Patent
Kuboyama et al.

(10) Patent No.: US 6,512,434 B1
(45) Date of Patent: Jan. 28, 2003

(54) CIRCUIT BREAKER WITH SHIFT GUIDE

(75) Inventors: Katsunori Kuboyama, Saitama (JP); Naoshi Uchida, Saitama (JP); Isamu Nagahiro, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 09/941,718

(22) Filed: Aug. 30, 2001

(30) Foreign Application Priority Data

Sep. 18, 2000 (JP) ..... 2000-281248

(51) Int. Cl.[7] ..... H01H 75/08
(52) U.S. Cl. ..... 335/45; 337/360; 337/392
(58) Field of Search ..... 335/35–42, 43–45; 337/360, 361, 362, 392, 333, 337, 48–49, 62, 70, 71–72, 77, 82, 103–104

(56) References Cited

U.S. PATENT DOCUMENTS 4,419,649 A * 12/1983 Walker et al. ..... 337/70
4,528,539 A * 7/1985 Forsell et al. ..... 337/49
4,691,184 A * 9/1987 Wulff ..... 337/49
5,825,273 A * 10/1998 Roger ..... 337/49
5,894,259 A * 4/1999 Kolberg et al. ..... 337/333

* cited by examiner

*Primary Examiner*—Lincoln Donovan
(74) *Attorney, Agent, or Firm*—Kanesaka & Takeuchi

(57) ABSTRACT

A thermal overload open-phase tripping device includes in a case bimetals corresponding to different phases; a differential shifter mechanism composed of a push shifter and a pull shifter, linked to operating ends of the bimetals, and an interlocking plate; and a compensating bimetal for transmitting output from the shifter mechanism to an opening and closing mechanism section of a breaker main body. The push and pull shifters are slidably supported to extend over interphase partition walls in the case, and a case cover is placed and held over the push and pull shifters. Rib-shaped projections projecting from an inner surface of the case cover and facing the top surfaces of the shifters are provided as shifter position guides to constrain inclination of the shifters moving in accordance with bending displacement of the bimetals to hold the shifters horizontally.

4 Claims, 5 Drawing Sheets

CIRCUIT BREAKER WITH SHIFT GUIDE

BACKGROUND OF THE INVENTION AND RELATED ART STATEMENT

The present invention relates to a circuit breaker incorporating a thermal overload open-phase tripping device used in a molded case circuit breaker applied to an electric-motor feeding circuit or the like.

The structure of a conventional circuit breaker, in this example, a molded case circuit breaker, which incorporates a bimetal-type thermal overload open-phase tripping device, is shown in FIGS. 6, 7(*a*) and 7(*b*). In these figures, reference numeral 1 denotes a breaker case (resin molding), reference numeral 2 denotes a case cover (resin molding) placed on the case 1, reference numerals 3 and 4 denote load-side main circuit terminals and power-supply-side main circuit terminals, reference numeral 5 denotes an opening and closing mechanism section for a main circuit contact shoe, reference numeral 6 denotes an opening and closing operating handle, reference numeral 7 denotes a bimetal-type thermal overload open-phase tripping device incorporated in the case 1, and reference numeral 8 denotes an instantaneous-operation-type solenoid-based overload tripping device. Although not shown, a main circuit breaking section composed of movable and fixed contact shoes and an arc extinguishing chamber is incorporated into a bottom side of the case 1.

Further, the thermal overload open-phase tripping device 7 includes bimetals 9U, 9V and 9W corresponding to different phases of a main circuit, a differential shifter mechanism 10, a compensating bimetal 11 also acting as a lever for linking the differential shifter mechanism 10 and a latch receiver 5*a* of the opening and closing mechanism section 5, an adjustable dial 11*a* for the compensating bimetal 11 and the like.

The interior of the case 1 is partitioned into chambers corresponding to the U, V, and W phases by interphase partition walls 1*a*. The bimetals 9U, 9V and 9W are laterally arranged in the chambers for the respective phases and have lower ends fixed to and supported by the case 1, as shown in FIG. 7(*a*). Heater wires 9*a* wound around the corresponding bimetals are connected to the main circuit to cause the bimetals to bend when a current is conducted through the heater wires to generate heat.

On the other hand, the differential shifter mechanism 10 is composed of an assembly of a plate-shaped push shifter 10*a* and a plate-shaped pull shifter 10*b*, arranged alongside the bimetals 9U, 9V and 9W, and an interlocking plate 10*c* extending over the top surfaces of the push shifter 10*a* and the pull shifter 10*b*. Each of the L-shaped arm portions extending laterally from the push shifter 10*a* and a corresponding L-shaped arm portion extending laterally from the pull shifter lob face each other across a top portion of the corresponding bimetal 9U, 9V or 9W, and the corresponding bimetal then acts as an operating end. Further, the interlocking plate 10*c* has an output end or projecting portion 10*c*-1 located at a side opposite to a side surface of the compensating bimetal 11.

The interphase partition walls 1*a* of the case 1 have recesses 1*a*-1 formed at upper edges thereof, in which the push shifter 10*a* and the pull shifter 10*b* are fitted, as shown in FIG. 7(*b*). The push shifter 10*a* and the pull shifter 10*b* extend over the interphase partition walls 1*a* and lie within the recesses 1*a*-1 so as to be loosely fitted therein to permit sliding. In an assembled state in which the case cover 2 is installed on the case 1, as shown in FIG. 7(*a*), the case cover 2 holds the differential shifter mechanism 10 to keep it from slipping from the recesses 1*a*-1 in the interphase partition walls 1*a*.

Since the operation of the thermal overload open-phase tripping device configured as described above is well known, a detailed description thereof is omitted. When an overcurrent flows through the main circuit to bend and displace the bimetals 9U, 9V and 9W in the direction of arrow P in FIG. 7(*a*), the push shifter 10*a* of the differential shifter mechanism 10 correspondingly slides in the direction of arrow Q to cause the output end of the interlocking plate 10*c* to push the compensating bimetal 11, thereby driving the latch receiver 5*a* (see FIG. 6) of the opening and closing mechanism section 5 to a release position. The opening and closing mechanism section 5 thereby performs a trip operation to open the contact shoes of the main circuit of the breaker, thereby shutting off the current.

The circuit breaker of the above conventional configuration has the problem such that overload open-phase tripping operation characteristics change, resulting in failure to operate as specified. The inventors' study has demonstrated that this problem originates from the support structure of the differential shifter mechanism. That is, in the differential shifter mechanism 10, the interlocking plate 10*c* is placed on the top surfaces of the push shifter 10*a* and the pull shifter 10*b* so as to extend over these surfaces, as previously described. Thus, in the conventional assembled structure, a gap corresponding to the thickness of the interlocking plate 10*c* remains between the top surfaces of the push shifter 10*a* and the pull shifter 10*b* and an inner wall surface of the case cover 2, as shown in FIG. 7(*a*).

Consequently, when the push shifter 10*a* of the differential shifter mechanism 10 is pushed due to the bending displacement of the bimetals 9U, 9V and 9W, it is inclined, using as a support point the abutting point between the output end of the interlocking plate 10*c* and the compensating bimetal 11, so that its rear end (right end in the figure) is raised. Thus, the rear edge of the raised shifter rubs against the inner surface of the case cover 2 to produce the sliding friction, and the inclined position of the shifter reduces the force for laterally pushing the compensating bimetal 11 via the interlocking plate 10*c*. As a result, the bending displacement of the bimetals 9 is not accurately transmitted to the compensating bimetal 11 via the differential shifter mechanism 10, varying the tripping operation characteristics of the breaker.

It is thus an object of the present invention to provide a circuit breaker that provides an improved support structure for a differential shifter mechanism so as to accurately transmit the bending displacement of bimetals to a compensating bimetal via a differential shifter mechanism without any loss, in order to stabilize the operational characteristics of a thermal overload open-phase tripping device.

Further objects and advantages of the invention will be apparent from the following description of the invention.

SUMMARY OF THE INVENTION

To attain the above object, the present invention provides a circuit breaker including a thermal overload open-phase tripping device. The tripping device is composed of bimetals corresponding to different phases of a main circuit; a differential shifter mechanism composed of a combination of a plate-shaped push shifter and a plate-shaped pull shifter linked to operating ends of the bimetals of the respective phases, and an interlocking plate extending over the top surfaces of both shifters; and a compensating bimetal also acting as a lever to transmit an output from the shifter mechanism to an opening and closing mechanism section to release a latch receiver. The push and pull shifters of the differential shifter mechanism extend over interphase partition walls in a breaker case and are loosely fitted into recesses formed at the upper edges of the interphase partition walls to permit sliding support. A case cover is placed and held over the push and pull shifters of the differential shifter mechanism.

In the invention, shifter position guides are provided on an inner surface side of the case cover opposite to the push and pull shifters to restrain inclination of the shifters moving in accordance with bending displacement of the bimetals to hold the shifters horizontally.

The position guides may be configured as rib-shaped projections projecting from an inner surface of the case cover along a shifter operating direction toward the top surfaces of rear portions of the push and pull shifters.

The position guides may be configured as rib-shaped projections projecting from an inner surface of the case cover along a direction traversing the top surfaces of the push and pull shifters and parallel to the interphase partition walls in the case.

In the above two situations, the tips of the rib-shaped projections and inner surfaces of the recesses in the interphase partition walls in which the push and pull shifters are loosely fitted for support are formed to have circular cross-sections, respectively.

According to the above configuration, in the differential shifter mechanism incorporated in the breaker case, the position guides projecting downward from the inner surface of the case cover are located opposite to the top surfaces of the push and pull shifters fitted into the recesses formed at the upper edges of the interphase partition walls of the case, in such a manner that a small gap is maintained to allow sliding movement of the shifters between the top surfaces and the position guides. If the shifters moving in accordance with the bending of the bimetals begin to incline forward, they abut against the position guides, thereby preventing their inclination. This allows the shifters to slide while maintaining their horizontal positions.

Furthermore, since the tips of the rib-shaped projections and the inner surfaces of the recesses in the interphase partition walls are formed to have circular cross-sections, respectively, the shifters slide smoothly without catching any part, reducing the sliding friction resistance. As a result, the bending displacement of the bimetals is accurately transmitted to the compensating bimetal via the differential shifter mechanism without any loss, thus stabilizing the tripping operation characteristic of the circuit breaker.

DETAILED DESCRIPTION OF PREFERRED EMBODIMENT

Figure 6:
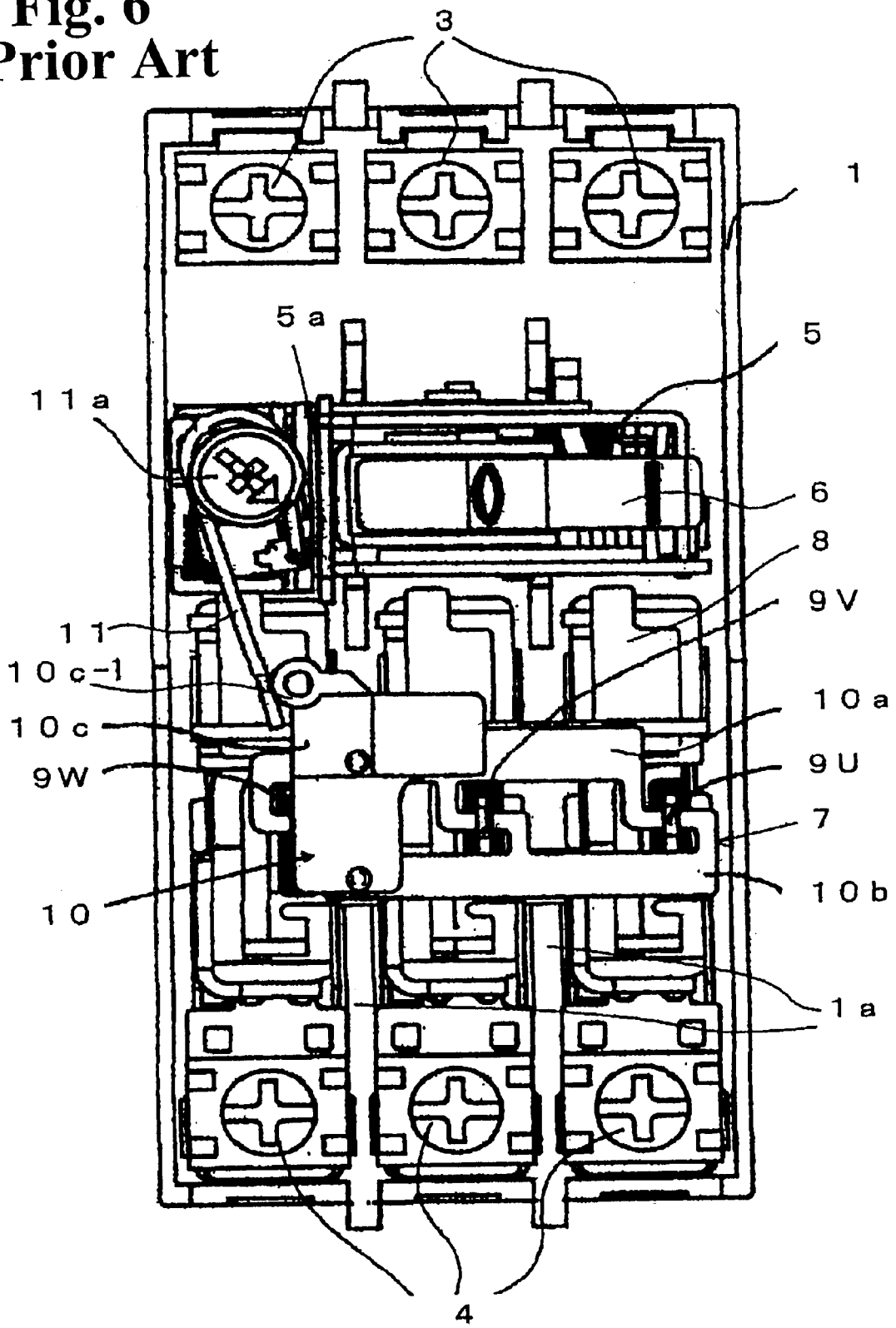
Fig. 6 Prior Art
FIG. 6 is a plan view showing the internal structure of a conventional circuit breaker, i.e. a molded case circuit breaker, wherein a case cover is removed.

An embodiment of the present invention will be described on the basis of an example shown in FIGS. 1–5. In the figures, as the example, members corresponding to those shown in FIGS. 6, 7(*a*) and 7(*b*) are denoted by the same reference numerals, and descriptions thereof are thus omitted.

Figure 7A:
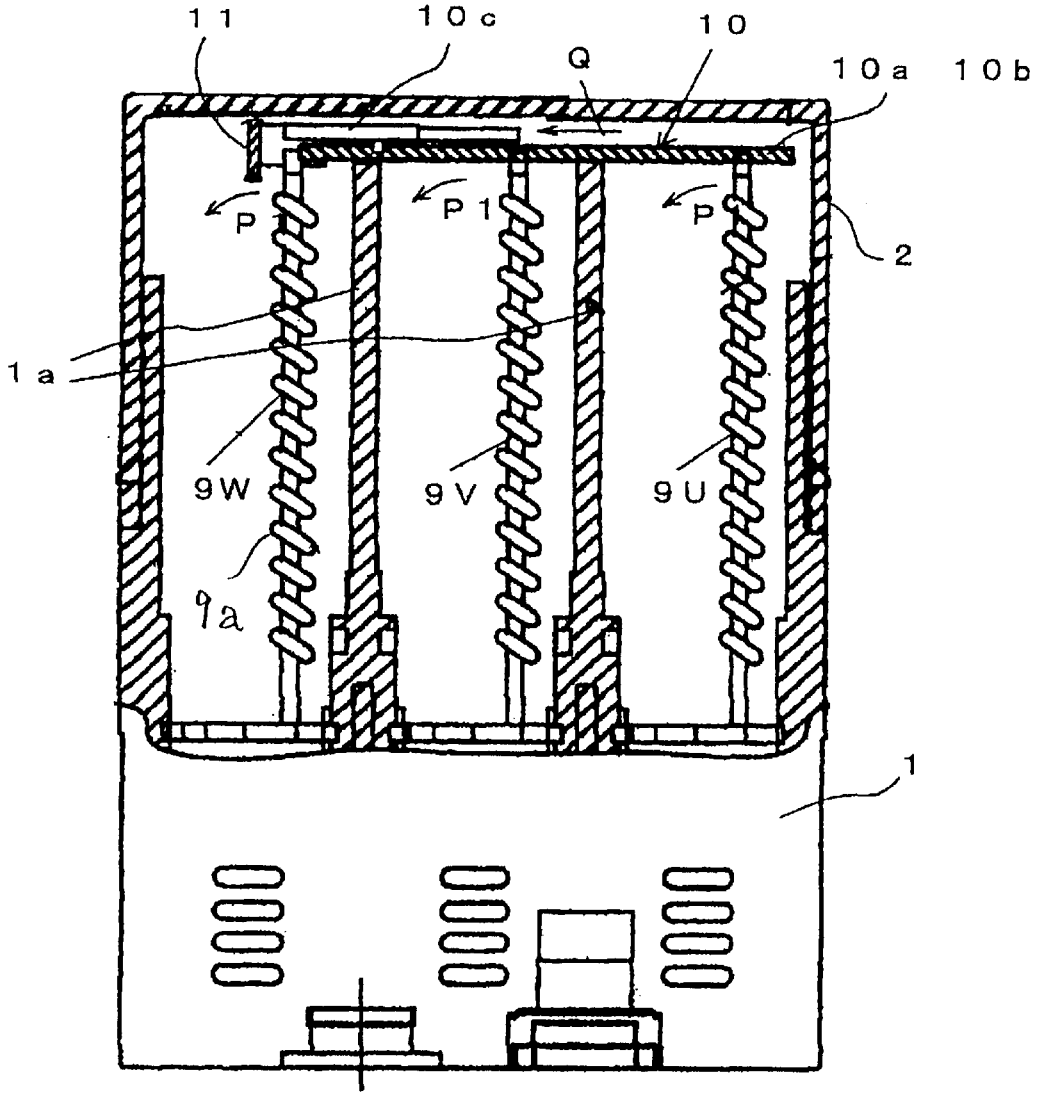
Fig. 7(a) Prior Art
FIG. 7(*a*) is a partially cut front view showing an assembled structure of a thermal overload open-phase tripping device in the circuit breaker shown in FIG. 6, wherein the case cover is attached, and FIG. 7(*b*) is a partially cut side view thereof.
Figure 7B:
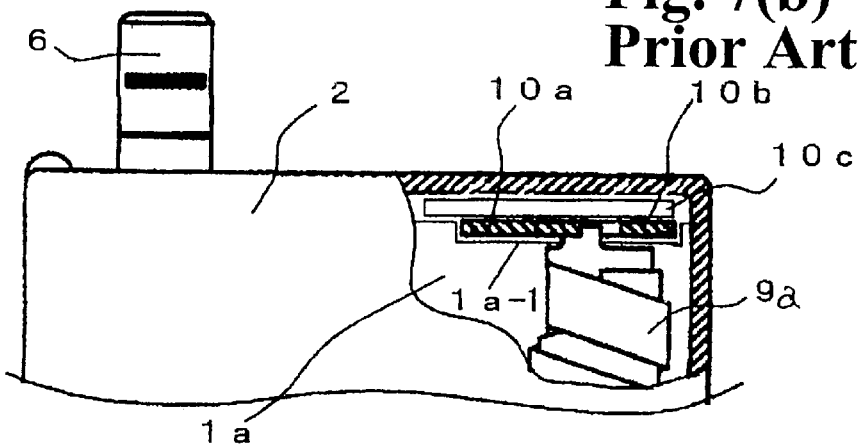
Fig. 7(b) Prior Art

That is, in the illustrated example, a case cover 2 has rib-shaped projections 2*a* and 2*b* formed on the inner surface of case cover 2 so as to project therefrom and functioning as position guides for the differential shifter mechanism 10, as compared to the conventional structure shown in FIG. 7. The rib-shaped projections 2*a* and 2*b* are integrally molded with the case cover 2, formed of a resin molding.

Figure 1:
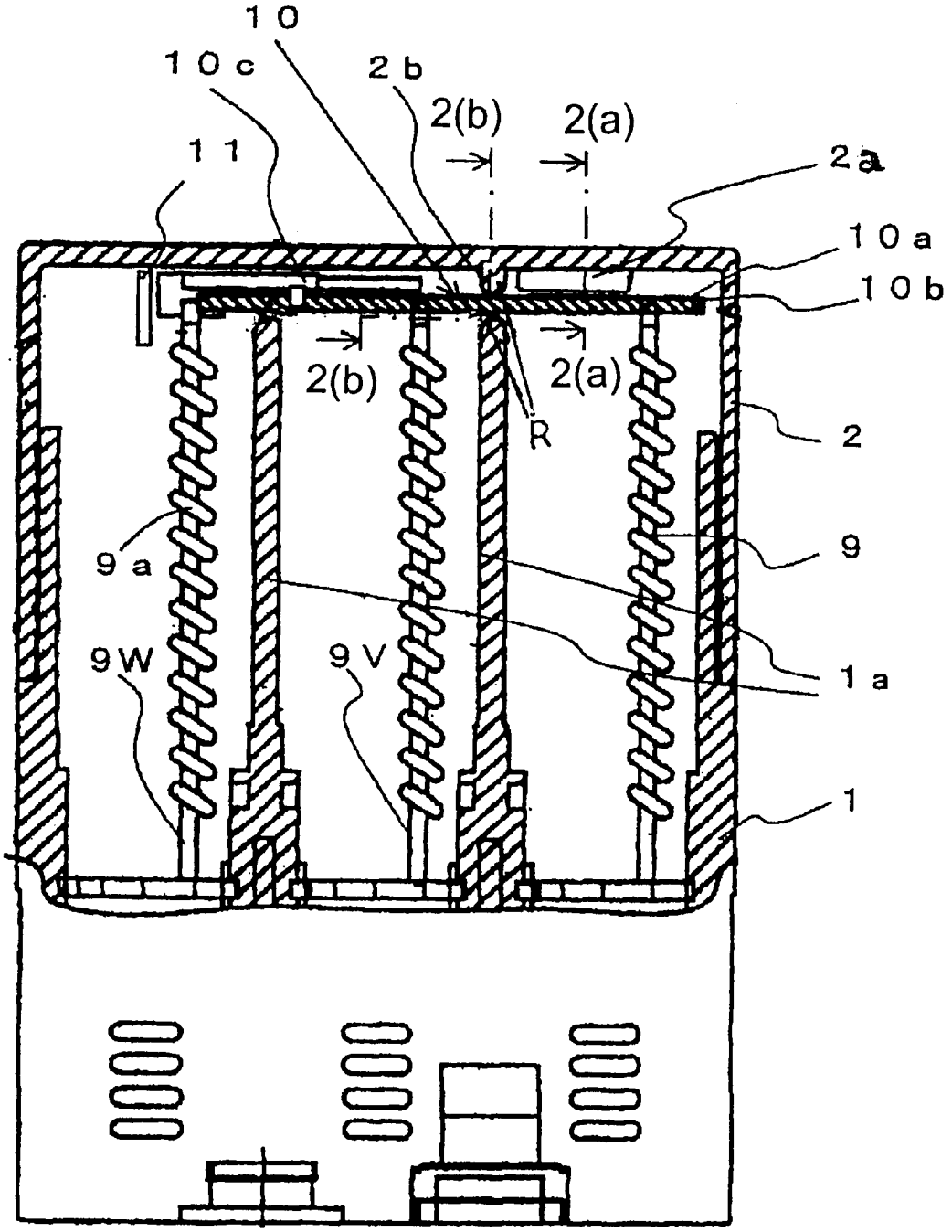
FIG. 1 is a sectional view of a circuit breaker showing a thermal overload open-phase tripping device and a shift support structure thereof according to an embodiment of the present invention.
Figure 2A:
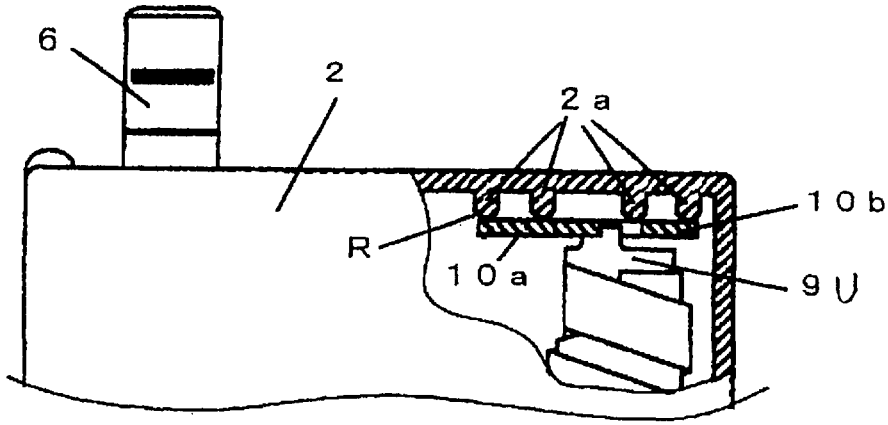
FIG. 2(*a*) is a sectional view taken along line 2(*a*)–2(*a*) in FIG. 1, and FIG. 2(*b*) is a sectional view taken along line 2(*b*)–2(*b*) in FIG. 1.
Figure 2B:
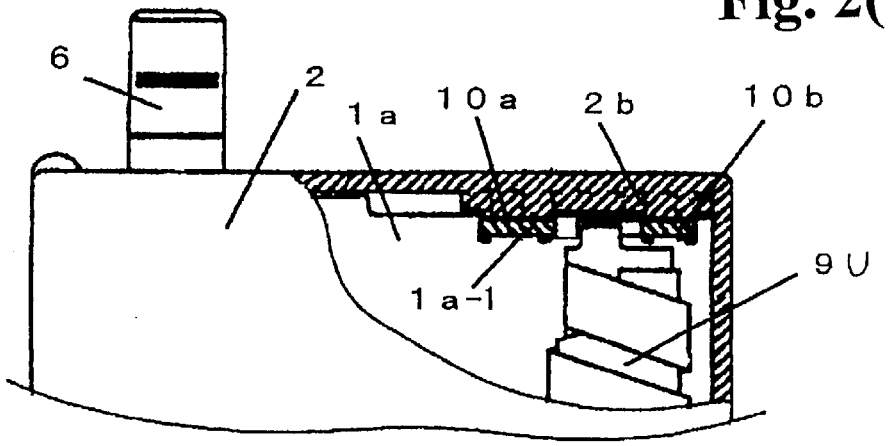
Figure 3:
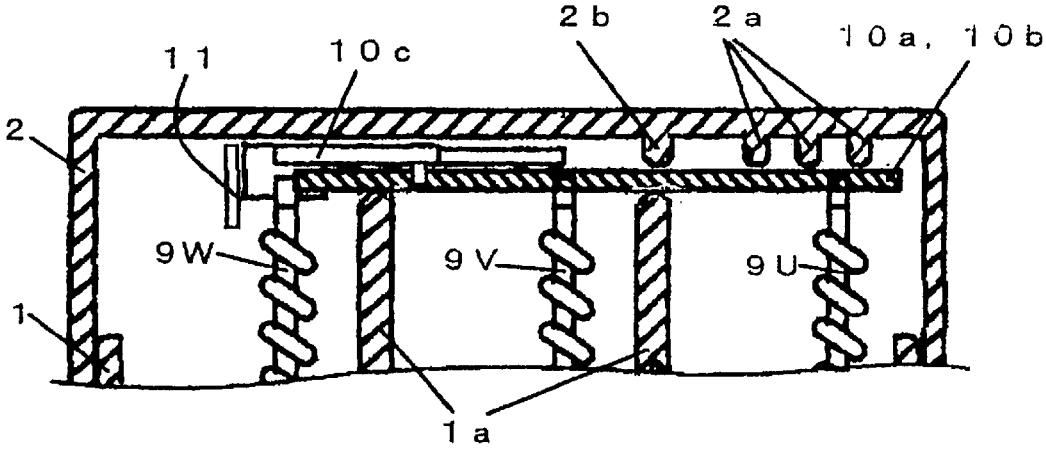
FIG. 3 is a sectional view showing a structure of a main part of an embodiment to which the present invention is applied.
Figure 4:
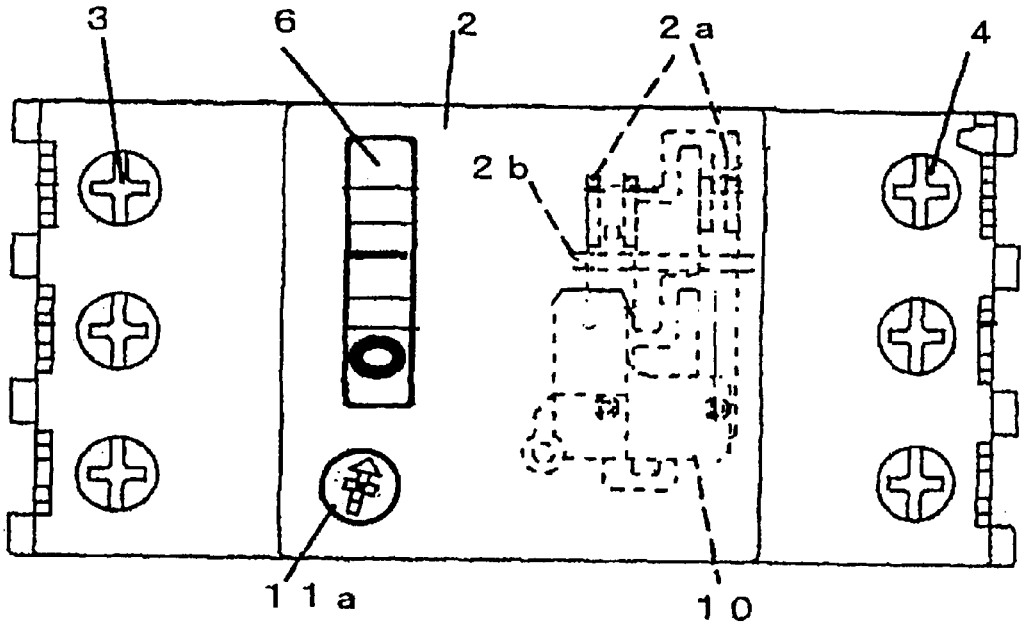
FIG. 4 is a plan view of the entire circuit breaker employing the shift support structure shown in FIG. 1.
Figure 5:
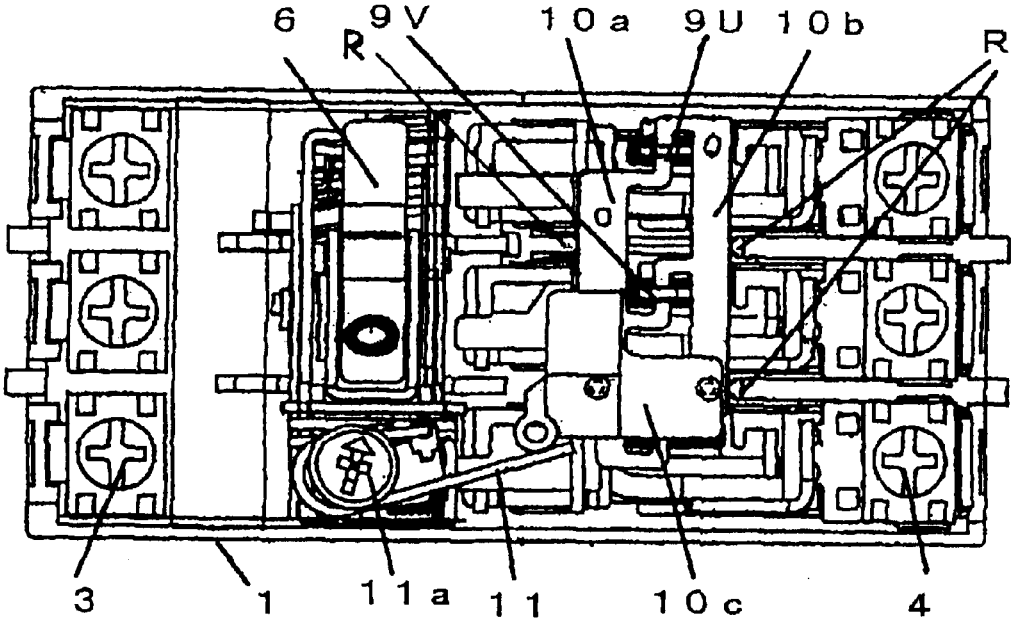
FIG. 5 is a plan view showing the internal structure of the circuit breaker shown in FIG. 4, wherein a case cover is removed.

The rib-shaped projections 2*a* face the top surfaces of the rear portions (located opposite to the interlocking plate 10*c* extending over the shifters) of the push shifter 10*a* and the pull shifter 10*b* of the differential shifter mechanism 10 and extending along the longitudinal axis thereof. Further, the rib-shaped projections 2*a* are formed to maintain a gap between themselves and the plate surfaces of the shifters 10*a* and 10*b*, and each of the tips is shaped to have a circular cross-section denoted by a reference R as shown in FIG. 2(*a*), so as to reduce a frictional resistance when they abut against the plate surfaces of the shifters 10*a* and 10*b*. On the other hand, the rib-shaped projection 2*b* extends parallel to the interphase partition walls 1*a* of the case 1 in a direction traversing the top surfaces of the push shifter 10*a* and the pull shifter 10*b*. As in the rib-shaped projections 2*a*, the tip of the rib-shaped projection 2*b* has a circular cross-section and faces the top surfaces of the shifters so that a small gap is maintained between itself and the top surfaces.

Moreover, the recess 1*a*-1 formed at the upper edge of the interphase partition wall 1*a* of the case 1 to support the shifters is chamfered so that a cross-section along an inner edge of the recess against which the shifters 10*a* and 10*b* abut, that is, a position of the recess 1*a*-1 located opposite to the rib-shaped projection 2*a*, is chamfered to have a circular shape, as shown by a reference R. The corner of the inner edge of the recess 1*a*-1, which presses the side edges of the shifters 10*a*, 10*b*, is also chamfered, as shown by a reference R in FIG. 5, so as to reduce the sliding resistance.

According to this configuration, when the differential shifter mechanism 10 operates in accordance with the bending displacement of the bimetals 9 (9U, 9V, 9W), the shifters 10*a* and 10*b* are pressed at the top surfaces of their rear portions by the rib-shaped projections 2*a* and 2*b*, and thus slide while maintaining their horizontal positions without inclining forward, as shown in FIGS. 7(*a*) and 7(*b*), thereby pushing the compensating bimetal 11 via the interlocking plate 10*c*. Furthermore, since each of the tips of the rib-shaped projections 2*a* and 2*b* and the inner edges of the recesses in the interphase partition walls 1*a* are formed to have the chamfered surface R with a circular cross-section, the sliding friction resistance between these components and the shifters is reduced. Consequently, the bending displacement of the bimetals 9 is accurately transmitted to the compensating bimetal 11 via the interlocking plate 10*c* without any significant loss, thus stabilizing the tripping operation characteristics of the circuit breaker.

As described above, according to the configuration of the present invention, the bending displacement of the bimetals of the thermal overcurrent open-phase tripping device incorporated in the circuit breaker can be accurately transmitted to the compensating bimetal via the differential shifter mechanism without any loss, thereby stabilizing the tripping operation characteristics of the circuit breaker.

While the invention has been explained with reference to the specific embodiment of the invention, the explanation is illustrative and the invention is limited only by the appended claims.

What is claimed is:

1. A circuit breaker comprising:

a breaker case having interphase partition walls with recesses, a main circuit situated in the breaker case, an opening and closing mechanism section for the main circuit, said mechanism having a latch receiver, a thermal overload open-phase tripping device including bimetals corresponding to different phases of the main circuit and having operating ends; a differential shifter mechanism having a push shifter and a pull shifter linked to the operating ends of the bimetals of the respective phases, and an interlocking plate extending over the push and pull shifters; and a compensating bimetal acting as a lever for transmitting an output from the shifter mechanism to the opening and closing mechanism section to release the latch receiver, said push and pull shifters extending over the interphase partition walls in the breaker case and loosely fitted in the recesses formed at upper edges of the interphase partition walls to be slidably supported thereat, a case cover placed and held over the push and pull shifters of the differential shifter mechanism, and shifter position guides provided on an inner surface side of the case cover opposite to the push and pull shifters to restrain inclination of the shifters moving in accordance with bending displacement of the bimetals to hold the shifters horizontally.

2. A circuit breaker according to claim 1, wherein said position guides are rib-shaped projections projecting from an inner surface of the case cover toward top surfaces of rear portions of the push and pull shifters and extending along a shifter operating direction.

3. A circuit breaker according to claim 1, wherein the position guides are rib-shaped projections projecting from an inner surface of the case cover along a direction traversing top surfaces of the push and pull shifters and parallel to the interphase partition walls in the case.

4. A circuit breaker according to claim 2, wherein tips of the rib-shaped projections and inner surfaces of the recesses in the interphase partition walls in which the push and pull shifters are loosely fitted for support are formed to have circular cross-sections, respectively.

* * * * *